US006590205B2

(12) United States Patent
Shiokawa et al.

(10) Patent No.: US 6,590,205 B2
(45) Date of Patent: Jul. 8, 2003

(54) IONIZATION METHOD FOR MASS SPECTROMETRY AND MASS SPECTROMETRY APPARATUS

(75) Inventors: Yoshiro Shiokawa, Hachioji (JP); Megumi Nakamura, Fuchu (JP); Tohru Sasaki, Fuchu (JP); Toshihiro Fujii, Hamura (JP)

(73) Assignee: Anelva Corporation, Tokyo (JP)

( * ) Notice: Subject to any disclaimer, the term of this patent is extended or adjusted under 35 U.S.C. 154(b) by 0 days.

(21) Appl. No.: 09/923,439

(22) Filed: Aug. 8, 2001

(65) Prior Publication Data

US 2002/0020813 A1 Feb. 21, 2002

(30) Foreign Application Priority Data

Aug. 10, 2000 (JP) ..... 2000-242473

(51) Int. Cl.[7] ..... H01J 49/26
(52) U.S. Cl. ..... 250/288; 250/281
(58) Field of Search ..... 250/281–282, 250/288, 289

(56) References Cited

U.S. PATENT DOCUMENTS 5,318,752 A * 6/1994 Visser ..... 422/83
5,485,016 A * 1/1996 Irie et al. ..... 250/281
6,410,914 B1 * 6/2002 Park et al. ..... 250/282

FOREIGN PATENT DOCUMENTS

JP 1-255146 10/1989
JP 6-011485 1/1994
JP 6-310091 11/1994

OTHER PUBLICATIONS

R. V. Hodges et al., "Application of Alkali in Chemical Ionization Mass Spectrometry", Analytical Chemistry, vol. 48, No. 6, May 1976, pp. 825–829.

Bombick et al., "Potassium Ion Chemical Ionization and Other Uses of an Alkali Thermionic Emitter in Mass Spectrometry", Analytical Chemistry, 1984, pp. 396–402.

Fujii et al., "Chemical Ionization Mass Spectrometry With Lithium Ion Attachment to the Molecule", Analytical Chemistry, 1989, pp. 1026–1029.

Fujii, "A Novel Method for Detection of Radical Species in the Gas Phase: Usage of Li+ Ion Attachment to Chemical Species", Chemical Physics Letters 191 (1992), pp. 162–168.

* cited by examiner

*Primary Examiner*—John R. Lee
*Assistant Examiner*—Paul M. Gurzo
(74) *Attorney, Agent, or Firm*—Oliff & Berridge, PLC

(57) ABSTRACT

Metal ions are attached to a sample gas in an ionization chamber to produce ions of the sample gas. The ions of the sample gas pass through a mass spectrometer formed by an electromagnetic field for separation by mass. The mass separated ions of the sample gas are detected and measured by a detector as an ion current. Further, a metal ion emitter for emitting metal ions is arranged at the upstream side of a region controlled to a reduced pressure atmosphere where the flow of gas becomes viscous, a sample gas inflow part for introducing the sample gas to the downstream side where the metal ions are transported, and the sample gas ionized by attachment of the metal ions passes through the opening of the aperture plate and transported to the mass spectrometer. A second gas inflow part is arranged at the upstream side of the metal ion producing region. A second gas supplied by the second inflow part flows through the metal ion producing region and sample gas ionization region. Due to this configuration, it is possible to suppress contact of the sample gas with the metal ion emitter, prevent contamination of the metal ion emitter, and perform mass spectrometry stably over a long term.

19 Claims, 11 Drawing Sheets

IONIZATION METHOD FOR MASS SPECTROMETRY AND MASS SPECTROMETRY APPARATUS

BACKGROUND OF THE INVENTION

1. Field of the Invention

The present invention relates to an ionization method for mass spectrometry and a mass spectrometry apparatus, more particularly relates to an ionization method for mass spectrometry based on ion attachment which suppresses the diassociation of a sample gas for mass spectrometry to enable stable ionization over a long period of even an organic compound gas or halogen-based gas and a mass spectrometry apparatus in which such an ionization method is used.

2. Description of the Related Art

In recent years, mass spectrometry has been broadly used for analysis of pollutants and extremely fine amounts of impurities contained in process gas for the production of semiconductors. In mass spectrometry, an ionized sample gas is passed through the inside of an electromagnetic field of a mass spectrometer to cause separation in accordance with mass and the separated components having specific masses of the sample gas are detected and measured by an electron multiplier or other detectors. For mass analysis of a sample gas, the sample gas has to be ionized at a previous stage.

As methods for ionization of the sample gas, in the past, electron impact ionization, atmospheric pressure ionization, and ion attachment ionization may be mentioned.

Electron impact ionization is a method for causing electrons to collide with a sample gas at a high speed and using the impact energy to strip electrons of the sample gas for ionization. Due to the higher impact energy, gas molecules (target analysis substance) themselves making up the sample gas are sometimes split (disassociated) and low molecular weight substances are produced. According to mass spectrometry based on electron impact ionization, fragment peaks of a lower molecular weight than the main peaks are produced when the mass of the gas molecules making up the sample gas are the main peaks respectively.

Atmospheric pressure ionization is the method of using a source of radiation or corona discharge to ionize a gas with a higher ionization potential than the target analysis substance and produce primary ions and causing those primary ions to collide with the target analysis substance to cause an ion/molecule reaction (charge transfer) and ionize the sample gas at pressure ($1\times10^5$ Pa). Since it uses a source of radiation etc. to generate the primary ions, at least the same number of electrons as the primary ions are produced. These electrons rebond with the primary ions to reduce the concentration of the primary ions. When the sample gas is an organic compound etc., an ion/molecule reaction with the primary ions does not easily occur.

Ion attachment ionization is a method of suppressing diassociation of the gas molecules making up the sample gas and of enabling efficient ionization. This ionization method is for example disclosed in Japanese Examined Patent Publication (Kokoku) No. 7-48371. Ion attachment ionization does not only ionize the sample gas effectively just under a high pressure such as atmospheric pressure ($1\times10^5$ Pa) but also can analyze the sample gas under a lower pressure.

The above-mentioned ion attachment ionization has been reported as the system of Hodge in *Analytical Chemistry,* vol. 48, no. 6, p. 825 (1976); the system of Bombick in *Analytical Chemistry,* vol. 56, no. 3, p. 396 (1984); and the system of Fujii et al. in *Analytical Chemistry,* vol. 1, no. 9, p. 1026 (1989), *Chemical Physics Letters,* vol. 191, no. 1.2, p. 162 (1992), and Japanese Unexamined Patent Publication (Kokai) No. 6-11485. Ion attachment ionization has developed as a modification of chemical ionization. On the other hand, ion attachment ionization can suppress the disassociation of a sample gas better than chemical ionization or atmospheric pressure ionization and in particular is effective in mass spectrometry of a polymer organic compound with a low bonding energy etc.

In ion attachment ionization, for example, a metal ion emitter containing an alkali metal salt is heated to ionize the alkali metal and emit ions. These metal ions are caused to gently attach to locations of concentrations of charges of the gas molecules making up the sample gas and substantially ionize the sample gas. An alkali metal is best suited for this ionization. The electrons contributing to this ionization of the metal are trapped inside the metal ion emitter and do not rebond with the metal ions emitted as primary ions, so the concentration of metal ions can be sufficiently enhanced. In ion attachment ionization, an inert gas such as $N_2$ or Ar is introduced together with the sample gas, and the inert gas and the ionized sample gas are made to collide to quickly strip the excess energy from the sample gas ions and stabilize the sample gas ions. This is because the excess energy produced when the metal ions attach to the sample gas becomes a cause of separating the sample gas ions into the sample gas and metal ions.

In ion attachment ionization, the efficiency of ionization of the sample gas is improved along with the amount of the $N_2$, Ar, or other inert gas introduced, that is, along with a rise in the pressure of the region of ionization. This ionization efficiency is seen to improve slightly along with a rise in pressure more than about 100 Pa as a critical pressure, but substantially becomes saturated at such a pressure. That is, under a pressure of over 100 Pa, the ionization efficiency becomes substantially constant.

According to ion attachment ionization, it was not possible to perform mass spectrometry stably over a long period. This is because the sample gas has an effect on the metal ion emitter depending on the type of the sample gas.

For example, when the sample gas is a polymer organic compound, heat decomposition occurs due to the heat transmitted from the heated metal ion emitter. That is, low molecular weight substances are produced. The low molecular weight substances are substantially ionized by attachment of the primary ions, that is, the metal ions. These pass through the mass spectrometer by an electric field and are transported to the detector. In the detector, for detection and measurement of the low molecular weight substances in addition to the target substance for mass spectrometry, fragment peaks are produced on the spectrum showing the results of analysis. Further, the low molecular weight substances deposit on the metal ion emitter and cover and conceal the surface. This reduces the area of the surface from which metal ions can be emitted. Sufficient metal ions can no longer be supplied inside the ionization chamber. As a result, the ionization efficiency of the sample gas falls.

Further, when for example the sample gas is a halogen gas or halogen-based radicals, the components of the emitter and the sample gas chemically react (corrosion reaction) at the surface of the metal ion emitter and cause a change in the performance of the metal ion emitter. In particular, in the case of halogen-based radicals, since a bias voltage is applied to the metal ion emitter, an etching reaction etc. are caused and the metal ion emitter itself is eaten away.

In this way, in the conventional ion attachment mass spectrometry apparatus and ionization method, there were the problems, depending on the type of the sample gas, of the occurrence of fragment peaks, a fall in the concentration of primary ions, and a reduction in the volume of the metal ion emitter itself and therefore the inability to ionize the sample gas stably over a long period and the inability to perform mass spectrometry correctly.

Note that as art related to this problem of the present invention, the atmospheric pressure ionization mass spectrometer disclosed in Japanese Unexamined Patent Publication (Kokai) No. 6-310091 may be mentioned. This atmospheric pressure ionization mass spectrometer enables analysis by adopting a double-wall tubular structure making the ion generation part and sample gas introduction part separate chambers at atmospheric pressure ($1\times10^5$ Pa) from the viewpoint of preventing flow of the gas back to the ion generation part when analyzing a silane-based gas etc. as the sample gas.

SUMMARY OF THE INVENTION

An object of the present invention is to provide an ionization method for mass spectrometry by ion attachment and a mass spectrometry apparatus enabling the components of a sample gas to be easily interpreted from results of analysis without disassociation of the sample gas, suppressing contact of the sample gas with the metal ion emitter to prevent contamination of the ion emitter, and enabling mass spectrometry stably over a long period.

To achieve the above object, the method of ionization for mass spectrometry and the mass spectrometry apparatus according to the present invention are comprised as follows:

The method of ionization of the present invention is a method used for mass spectrometry attaching metal ions to a sample gas in an ionization chamber to produce sample gas ions, passing the sample gas ions through a mass spectrometry part formed by an electromagnetic field for separation by mass, and detecting and measuring the mass separated sample gas ions as an ion current.

A first method of ionization produces metal ions at the upstream side of a region controlled to a reduced pressure atmosphere where the flow of gas becomes a viscous flow, transports the metal ions to the downstream side by at least the flow of gas formed inside the ionization chamber, and introduces the sample gas to the downstream side region to produce the sample gas ions. The metal ions may be transported to the downstream side using an electric field instead of using a flow of gas.

The ionization method using ion attachment is characterized in that, when ionizing the sample gas, (1) the sample gas can be ionized by a higher pressure than with a normal ionization method (electron impact ionization), (2) the second gas required for ionization of the sample gas is a chemically stable inert gas such as $N_2$ or Ar and is resistant to attachment of metal ions, (3) the sample gas ionized in the mass spectrometry can be sufficiently detected and measured in trace amounts and almost all of the gas components in the ionization chamber can be formed by chemical stable inert gases. According to this ionization method, ions of the sample gas are produced while suppressing contact of the sample gas with the metal ion emitter. In production of the ions of the sample gas, metal ions emitted from a metal ion emitter are attached to the sample gas to substantially ionize the sample gas. Here, "substantially ionize the sample gas" means that the gas molecules forming the sample gas are not themselves ionized, but have equivalent properties to ions when metal ions are gently attached to locations of concentrations of charges of the gas molecules. "Viscous flow" means the state where the molecules present in a certain region have the property of a continuous fluid. In particular, it is characterized by lamellar flow lines with sufficiently little irregularity of the speed and direction of flow and flowing smoothly around objects. In the present invention, the parts of the fluid preferably flow drawing a smooth path without intermixing like a flow of a viscous fluid.

A second method of ionization comprises the first method further comprising successively replacing the atmosphere with a second gas introduced to the ionization chamber to produce a flow of gas in an evacuation direction to evacuate the ionization chamber from a second gas inflow part through a metal ion producing region and sample gas ionization region. By continuing to send the second gas from the second gas inflow part to make the direction of flow of the gas as explained above, it is possible to prevent contact between the metal ion emitter and the sample gas.

A third method of ionization comprises the second method further comprising reducing a conductance of a mid-stream region between a downstream side region where the sample gas is introduced and an upstream side region where the metal ions are produced so that the flow rate of the flow of gas becomes the fastest in the mid-stream region. By providing this mid-stream region, it is possible to reliably prevent diffusion of the sample gas introduced to the downstream side toward the metal ion emitter.

A fourth method of ionization comprises the second method wherein an inflow position of the second gas introduced to the ionization chamber is at the upstream side of the metal ion producing region.

A mass spectrometry apparatus using ion attachment according to the present invention is configured to attach metal ions to a sample gas in an ionization chamber to produce sample gas ions, pass the sample gas ions through a mass spectrometry part formed by an electromagnetic field for separation by mass, and detect and measure the mass separated sample gas ions as an ion current by a detector. In this configuration, a first mass spectrometry apparatus is configured to arrange a metal ion emitter for emitting the metal ions at an upstream side of a region controlled to a reduced pressure atmosphere where the flow of gas becomes a viscous flow, arrange a sample gas inflow part for introducing the sample gas to the downstream side where the emitted metal ions are transported, and transport the sample gas ionized by attachment of metal ions through an opening of an aperture plate to the mass spectrometry part.

A second mass spectrometry apparatus is comprised of the first spectrometry apparatus wherein the opening of the aperture plate is used as an evacuation port, a second gas is introduced from a second gas inflow part provided at an upstream-side most position of the ionization chamber, and thereby a direction of flow of the flow of gas becomes a direction from the second gas inflow part, through a region where the metal ion emitter is arranged and a region where the sample gas inflow part is arranged, and to the opening of the aperture plate.

A third mass spectrometry apparatus is comprised of the first spectrometry apparatus wherein a second ionization chamber is arranged between the metal ion emitter and the aperture plate, the sample gas inflow part is connected to a second ionization chamber so that the sample gas is introduced inside, holes are formed at each side of the metal ion emitter and aperture plate of a container forming the second ionization chamber, an evacuation part is provided at the second ionization chamber, and the second gas is introduced from the second gas inflow part while evacuating the ionization chamber from the evacuation part.

A fourth mass spectrometry apparatus is comprised of the first spectrometry apparatus wherein the second gas inflow part is arranged at regions of a front side and rear side of the sample gas inflow part in the ionization chamber in a direction of gas flow, an evacuation unit is provided at a position closer to a region of arrangement of the sample gas inflow part than a region of arrangement of the second gas inflow part, and a flow of gas is formed in a direction from the second gas inflow part through the region of arrangement of the sample gas inflow part to the evacuation part.

A fifth mass spectrometry apparatus is comprised of the first spectrometry apparatus wherein in a mid-stream region between the region where the sample gas is introduced and the region where metal ions are produced, a wall forming the ionization chamber is provided with a structural part for reducing the sectional area in a direction perpendicular to the flow of gas from another region.

A sixth mass spectrometry apparatus is comprised of the first spectrometry apparatus wherein a front end of the sample gas inflow part is made a donut-shaped tube having a plurality of gas discharge ports and the sample gas is quickly diffused near the region where the sample gas flows in.

A seventh mass spectrometry apparatus comprises the first spectrometry apparatus wherein curved parts are provided at inside surfaces of corners of the ionization chamber to create a viscous flow of gas without causing gas pockets.

An eighth mass spectrometry apparatus comprises the second spectrometry apparatus provided with an emitter chamber inside the ionization chamber, having the metal ion emitter arranged inside the emitter chamber, and having the emitter chamber connected to the second gas inflow part and having a tubular outlet.

A ninth mass spectrometry apparatus comprises the eighth spectrometry apparatus wherein the emitter chamber has an aperture-shaped opening instead of the tubular outlet.

In the above method and apparatus, preferably the reduced pressure atmosphere for making the flow of gas a viscous flow is controlled by an evacuation action by a differential evacuation mechanism arranged at the downstream side. In addition, the reduced pressure atmosphere for making the flow of gas a viscous flow may be preferably controlled by a gas introduction action by a gas introduction system.

In the above method and apparatus, preferably the sample gas is one of an organic compound gas, a halogen gas, and halogen-based radicals.

The following effects are exhibited by the present invention. Since metal ions are produced at an upstream side in a region controlled in direction of flow of gas so as to head from a second gas inflow part to an evacuation port in the ionization chamber and the sample gas is ionized in the downstream side region, it is possible to suppress contact between the metal ion emitter and sample gas and possible to prevent a deterioration in performance of the metal ion emitter depending on the type of the gas. Therefore, it is possible to attach metal ions to a sample gas to ionize the sample gas stably over a long period and as a result to perform accurate mass spectrometry.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Figure 1:
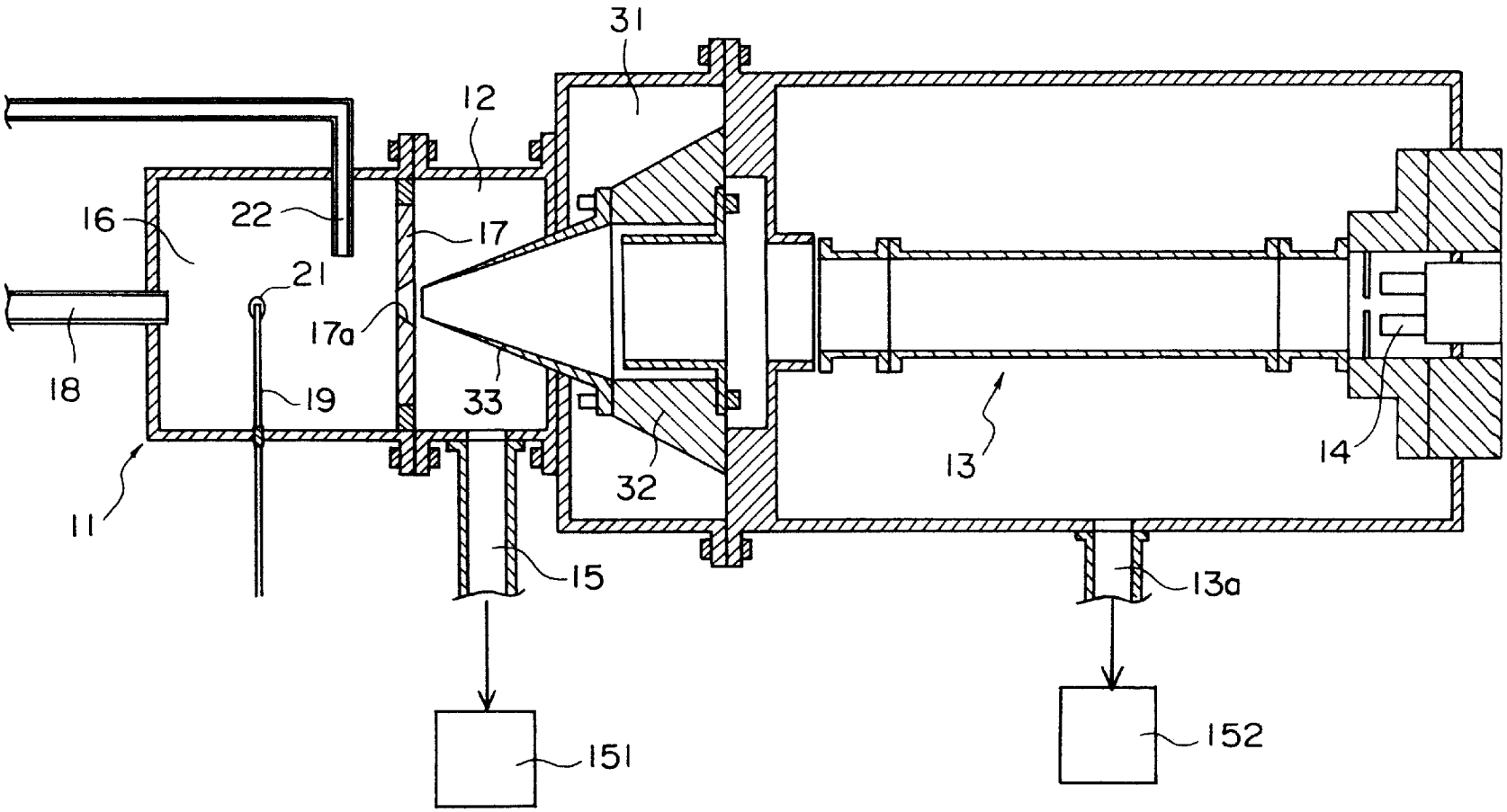
FIG. 1 is a longitudinal sectional view of the overall configuration of an ion attachment type mass spectrometry apparatus according to a first embodiment of the present invention.

Preferred embodiments of the present invention will be explained next with reference to the drawings.

A first embodiment of the present invention will be explained with reference to FIG. 1 and FIG. 2. The ion attachment mass spectrometry apparatus according to the first embodiment is provided with an ion source 11 for ionizing and accelerating a sample gas (detected gas), a differential evacuation chamber 12, a mass spectrometer 13 for separating and analyzing the ionized sample gas by mass, and a detector 14 for detecting and measuring the separated sample gas as an ion current. The differential evacuation chamber 12 is provided with an evacuation use vacuum pump. Reference numeral 15 is an evacuation pipe connected to the vacuum pump 151. The mass spectrometer 13 is for example a Q-pole type mass spectrometer or a quadrapole type mass spectrometer. The mass spectrometer 13 is normally in a high vacuum state for correct separation and analysis. Reference numeral 13*a* is an evacuation pipe connected to a vacuum pump 152. The differential evacuation chamber 12 is provided between the mass spectrometer 13 and ion source 11 so as not to break the high vacuum state of the mass spectrometer 13. An electron multiplier is used for the detector 14.

The ion source 11 forms an ionization chamber 16 into which are introduced a small amount of the sample gas and a second gas of an inert gas such as $N_2$ or Ar to form a reduced pressure atmosphere. As the sample gas, a gas of an organic compound or a halogen gas or halogen-based radicals may be used. The second gas is for example an inert gas of $N_2$ or Ar and has the function of quickly stripping the excess energy produced when the metal ions attach to the sample gas and the function of diluting the sample gas. The ionization chamber 16 is provided with an aperture plate 17 having an opening 17*a* at the right end in FIG. 1. A second gas inflow part 18 is provided at the left end (upstream side).

Two lead wires 19 connected to a power source provided outside of the ion source 11 are led inside the ionization chamber 16. A heating wire 20 (shown in FIG. 4) electrically connected to the front ends of these lead wires 19 is provided. The heating wire 20 further has attached to it a metal ion emitter 21 containing a metal salt formed in a bead shape. A sample gas inflow part 22 is provided between the metal ion emitter 21 and the aperture plate 17.

In the above, the metal salt of the metal ion emitter 21 is preferably an alkali metal salt most producing metal ions when heated, but may also be a metal such as Al or In which emit metal ions in the same way as an alkali metal salt. Further, if the metal ion emitter 21 is made a mixture of alumina silicate and a metal salt, it is possible to easily attach it to the heating wire.

The pressure inside the ionization chamber 16 is made a reduced pressure of about 100 Pa by introducing the second gas from the second gas inflow part 18. The flow of gas under this pressure is the flow of a viscous fluid. The parts of the fluid flow draw a smooth path without intermixing. The second gas in the ionization chamber 16 is continuously evacuated from an opening 17*a* provided at the aperture plate 17 as an evacuation port for successive replacement through the evacuation pipe 15 from the vacuum pump 151 provided at the differential evacuation chamber 12. Therefore, the gas flows from the second gas inflow part 18 in the direction of the opening 17*a* provided at the aperture plate 17.

If passing a current to the heating wire 20 through the lead wires 19 for electrical heating, the metal ion emitter 21 attached to the heating wire is also heated and metal ions are emitted from its surface. For emission of metal ions, if supplying a bias voltage against the aperture plate 17 of a ground potential to the metal ion emitter 21 through the lead wires 19 and heating wire 20, it is possible to emit and accelerate metal ions by the electric field formed in the ionization chamber 16. The emitted metal ions are transported to the downstream side region by the electric field formed in the ionization chamber 16 and the flow of the second gas. Since the sample gas is introduced from the sample gas inflow part 22 to the downstream side region, metal ions attach to the sample gas and substantially ionize the sample gas.

The ionized sample gas is accelerated as it is by the electric field, passes through the opening 17*a* provided in the aperture plate 17, and is transported to the mass spectrometer 13. In the mass spectrometer 13, the ionized sample gas is separated by mass and analyzed. The separated sample gas is detected and measured as an ion current by the detector 14.

A connecting chamber 31 is provided between the differential evacuation chamber 12 and the mass spectrometer 13. Inside the connecting chamber 31 is provided a tube 32 having a frustoconical outside shape and formed with an axial bore inside. At the front of the tube 32 is provided a tubular guide member 33 having a reverse megaphone shape. The guide member 33 is provided inside the differential evacuation chamber 12. The front opening is arranged close to the opening 17*a* of the aperture plate 17.

Figure 2:
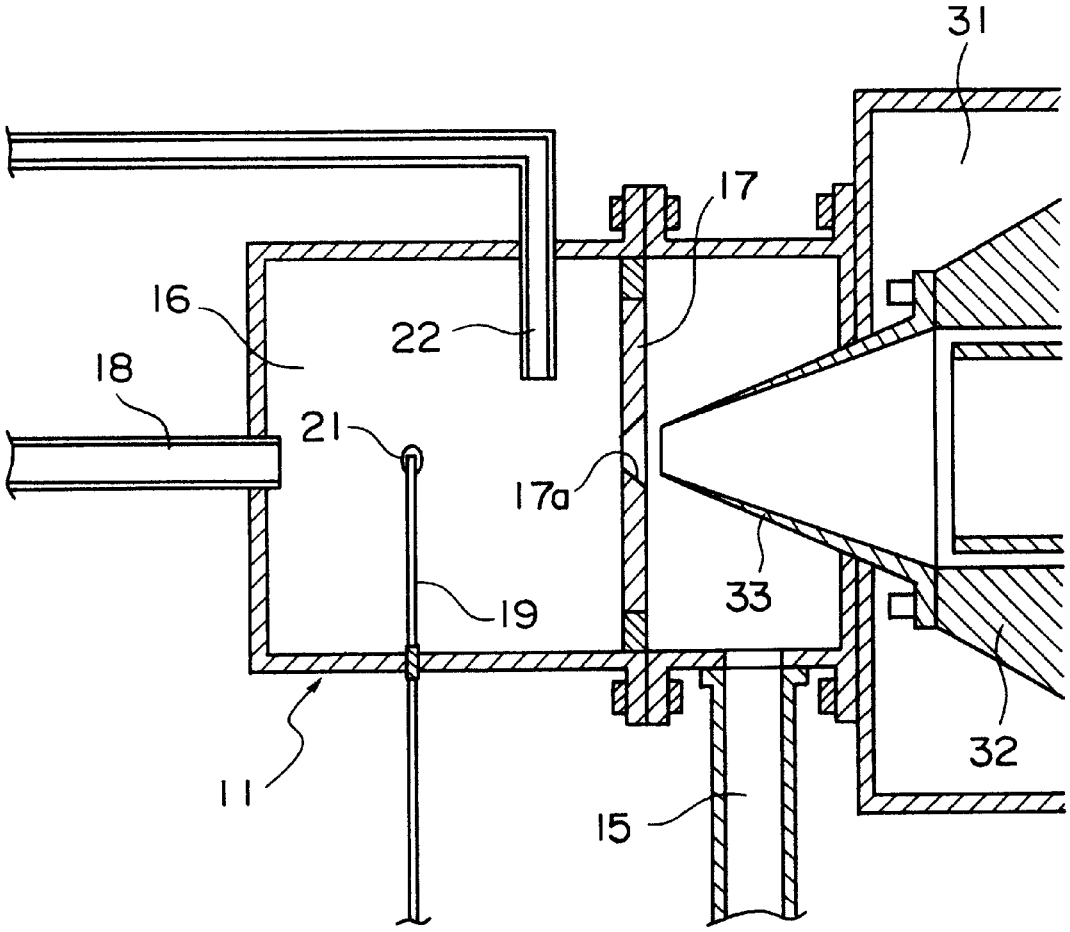
FIG. 2 is a longitudinal sectional view showing the portion of the ion source shown in FIG. 1 enlarged.

According to the first embodiment, in FIG. 1 and FIG. 2, a second gas inflow part 18 for introducing the second gas is provided at the left end wall of the ionization chamber 16 so as to enable control for creating a reduced pressure atmosphere by which the flow of gas becomes a viscous flow in the ionization chamber 16. Further, a metal ion emitter 21 for emitting metal ions is arranged at the upstream side of the region controlled to a reduced pressure atmosphere where the flow of gas becomes a viscous flow, while a front blow port of the sample gas inflow part 22 for introducing the sample gas is arranged at the downstream side where the metal ions are transported. Due to this, it is possible to suppress contact of the sample gas with the metal ion emitter 21 and possible to prevent contamination of the metal ion emitter by the organic compound gas.

Figure 3:
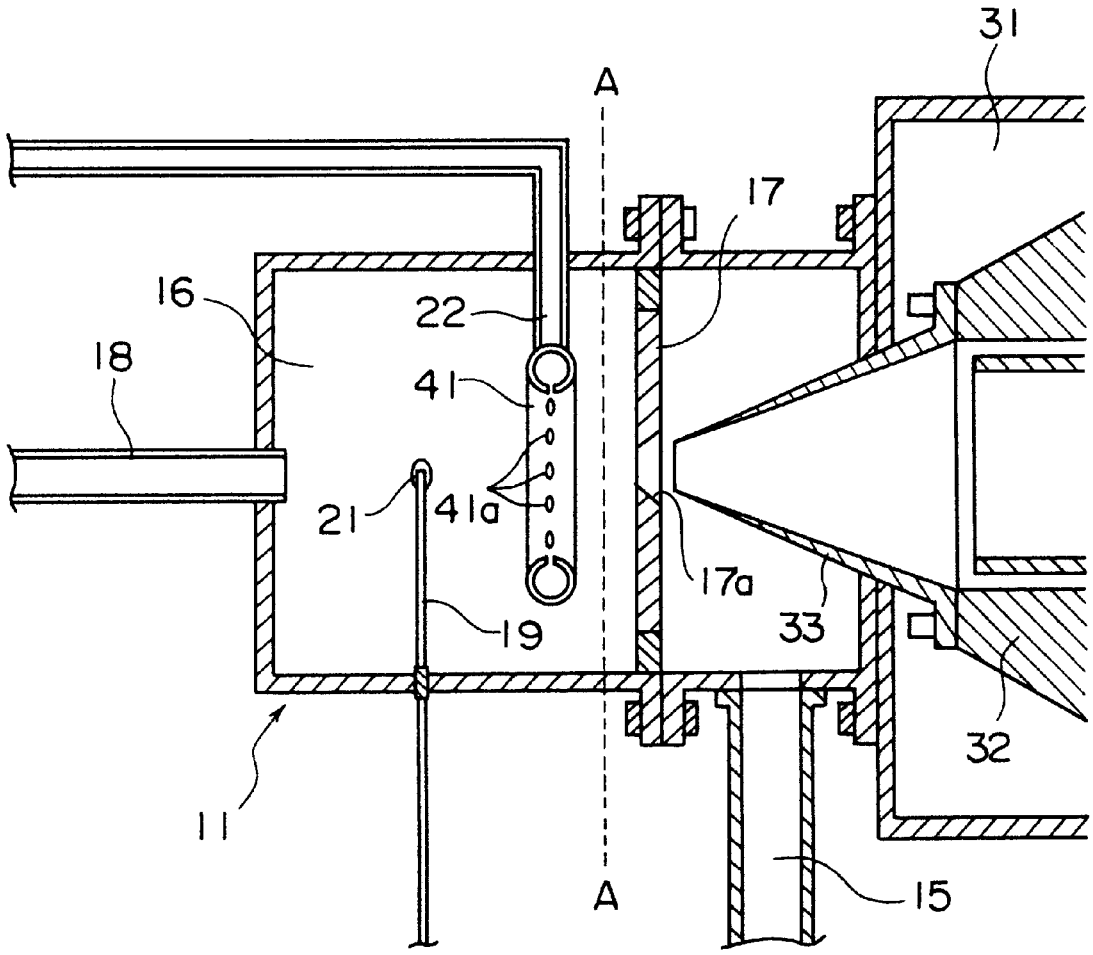
FIG. 3 is a similar longitudinal sectional view as FIG. 2 for a second embodiment of the present invention.
Figure 4:
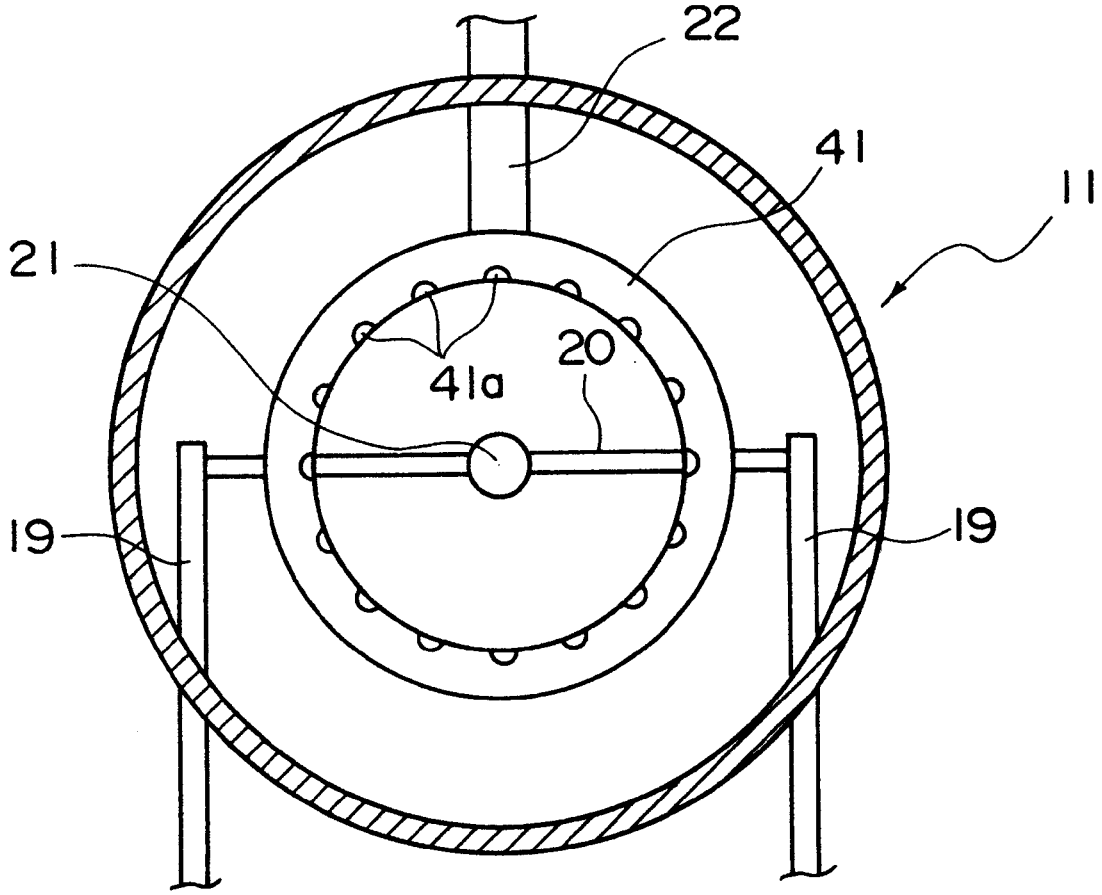
FIG. 4 is a sectional view along the line A—A of FIG. 3 seen from the aperture plate side.

Next, a second embodiment of the present invention will be explained with reference to FIG. 3 and FIG. 4. FIG. 3 shows an ion source similar to that in the above FIG. 2 enlarged, while FIG. 4 is a sectional view along the line A—A in FIG. 3 seen from the aperture plate side. The overall configuration of the ion attachment mass spectrometry apparatus of the second embodiment is basically the same as the configuration shown in FIG. 1. In FIG. 3 and FIG. 4, elements substantially the same as the elements explained in the first embodiment are assigned the same reference numerals.

The features of the second embodiment will be explained next. In the mass spectrometry apparatus according to the second embodiment, in the ionization chamber 16, the front end of the sample gas inflow part 22 arranged at the downstream side of the region controlled in flow of gas is structured as a donut-shaped tube 41. A plurality of gas emitting ports 41*a* are formed at the inner circumferential wall of the donut-shaped tube 41. The donut-shaped tube 41 is provided in a positional relationship so as to become concentric with the center axis of the ionization chamber 16. Further, it is preferably arranged to be concentric even with respect to the opening 17*a* provided at the aperture plate 17. If the pipe-shaped sample gas inflow part 22 is provided as a donut-shaped tube 41, it is possible to quickly diffuse and introduce the sample gas in the region downstream of the region controlled in flow of gas while suppressing contact of the sample gas and metal ion emitter 21. Due to this, it is possible to increase the region in which the sample gas is ionized. That is, it is possible to improve the ionization efficiency. Note that in FIG. 4, the metal ion emitter 21 and the donut-shaped tube 41 of the sample gas inflow part are arranged in a concentric positional relationship, but it is also possible to arrange the metal ion emitter 21 away from the axis.

Figure 5:
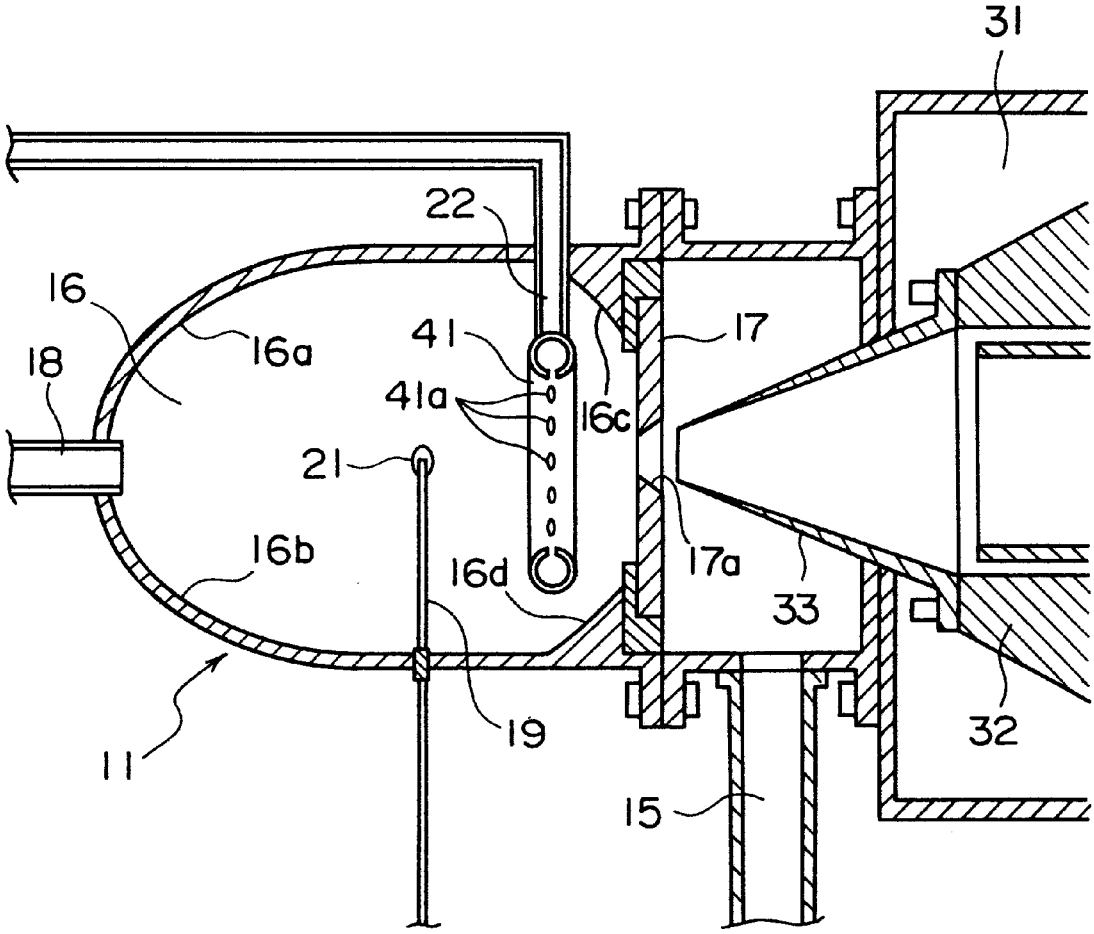
FIG. 5 is a similar longitudinal sectional view as FIG. 2 for a third embodiment of the present invention.

A third embodiment of the present invention will be explained with reference to FIG. 5. FIG. 5 is a view similar to FIG. 3. In FIG. 5, elements substantially the same as the elements explained in the previous embodiments are assigned the same reference numerals. The direction of flow of the gas in the ionization chamber 16 is set by the positional relationship with the evacuation port for evacuating the second gas inflow part 18 and the ionization chamber 16, that is, the opening 17*a* of the aperture plate 17. Therefore, in the third embodiment, while maintaining the positional relationship, corners of the inner walls 16*a*, 16*b*, 16*c*, and 16*d* of the ion source 11 forming the ionization chamber 16 are removed by for example curving to eliminate regions where gas pockets will easily form. According to the structure of this ionization chamber 16, even the gas flowing near the inside walls forming the ionization chamber 16 can be controlled to flow smoothly along the curved inside walls. Therefore, the flow of the gas from the second gas inflow part 18 to the opening 17*a* of the evacuation port can be stabilized and diffusion to the upstream side of the sample gas introduced from the donut-shaped tube 41 to the ionization chamber 16 can be suppressed.

Figure 6:
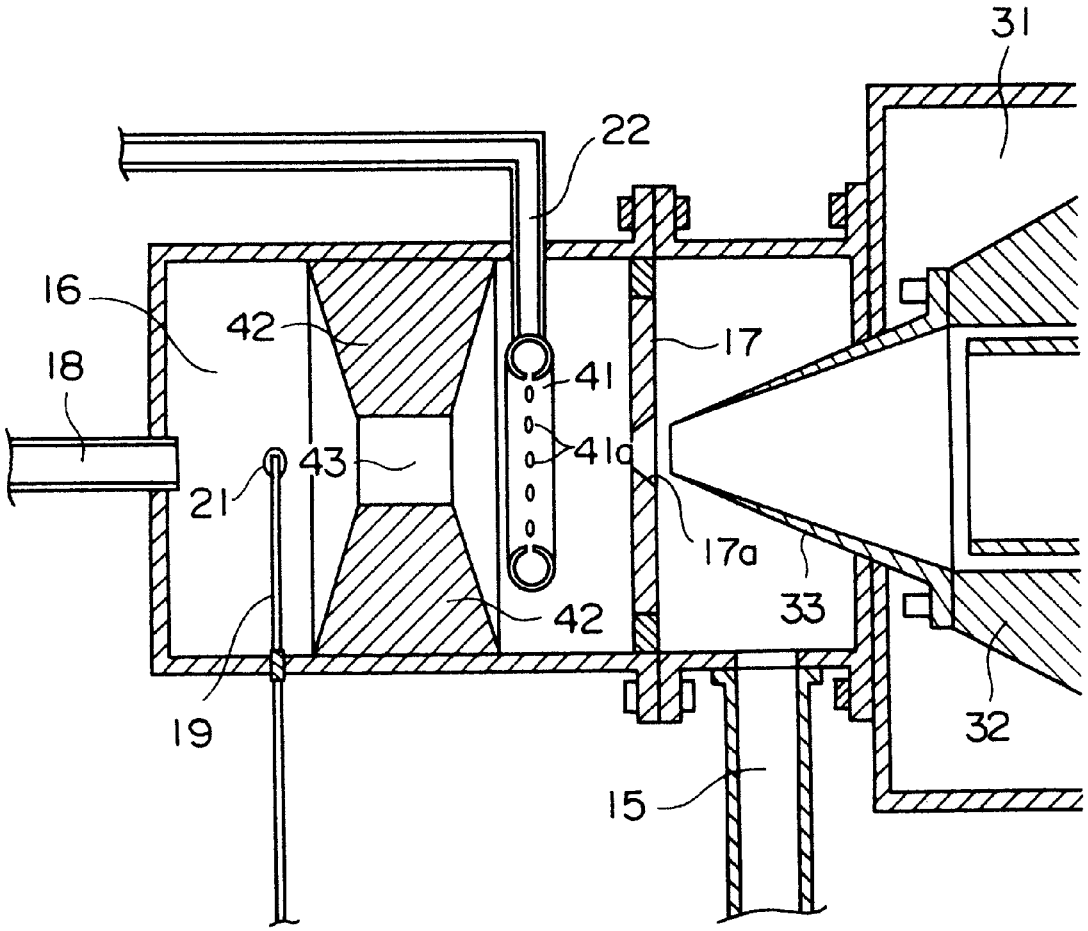
FIG. 6 is a similar longitudinal sectional view as FIG. 2 for a fourth embodiment of the present invention.

A fourth embodiment of the present invention will be explained with reference to FIG. 6. FIG. 6 is a view similar to FIG. 2. In FIG. 6, elements substantially the same as the elements explained in the previous embodiments are assigned the same reference numerals and detailed explanations thereof are omitted. In the fourth embodiment, the ionization chamber 16 is provided with a structural part 42 reducing the volume of the region between the metal ion emitter 21 and the donut-shaped tube 41 for introducing the sample gas. The structural part 42 is for example a donut-shaped member. Therefore, the gas channel 43 formed at the center of the structural part 42 is formed as a hole reduced in diameter. In the region of the gas channel 43, the flow rate of the gas is increased and it is possible to better suppress the diffusion of the sample gas to the upstream side.

The flow rates of the second gas and the sample gas are preferably independently controlled when introducing them into the ionization chamber 16. In particular, since the sample gas can be sufficiently detected and measured even in a small flow rate compared with the second gas, the sample gas is preferably made a so small amount compared with the second gas, that the flow of the gas in the ionization chamber 16 (lamellar flow) is not inhibited, and the diffusion of the sample gas to the upstream side is suppressed. This can be realized by providing for example mass controllers or other flow rate controllers at the gas feed paths independently connected to the second gas inflow part and the sample gas inflow part and changing the flow rates of the second gas and the sample gas while monitoring the pressure of the ionization chamber 16.

Figure 7:
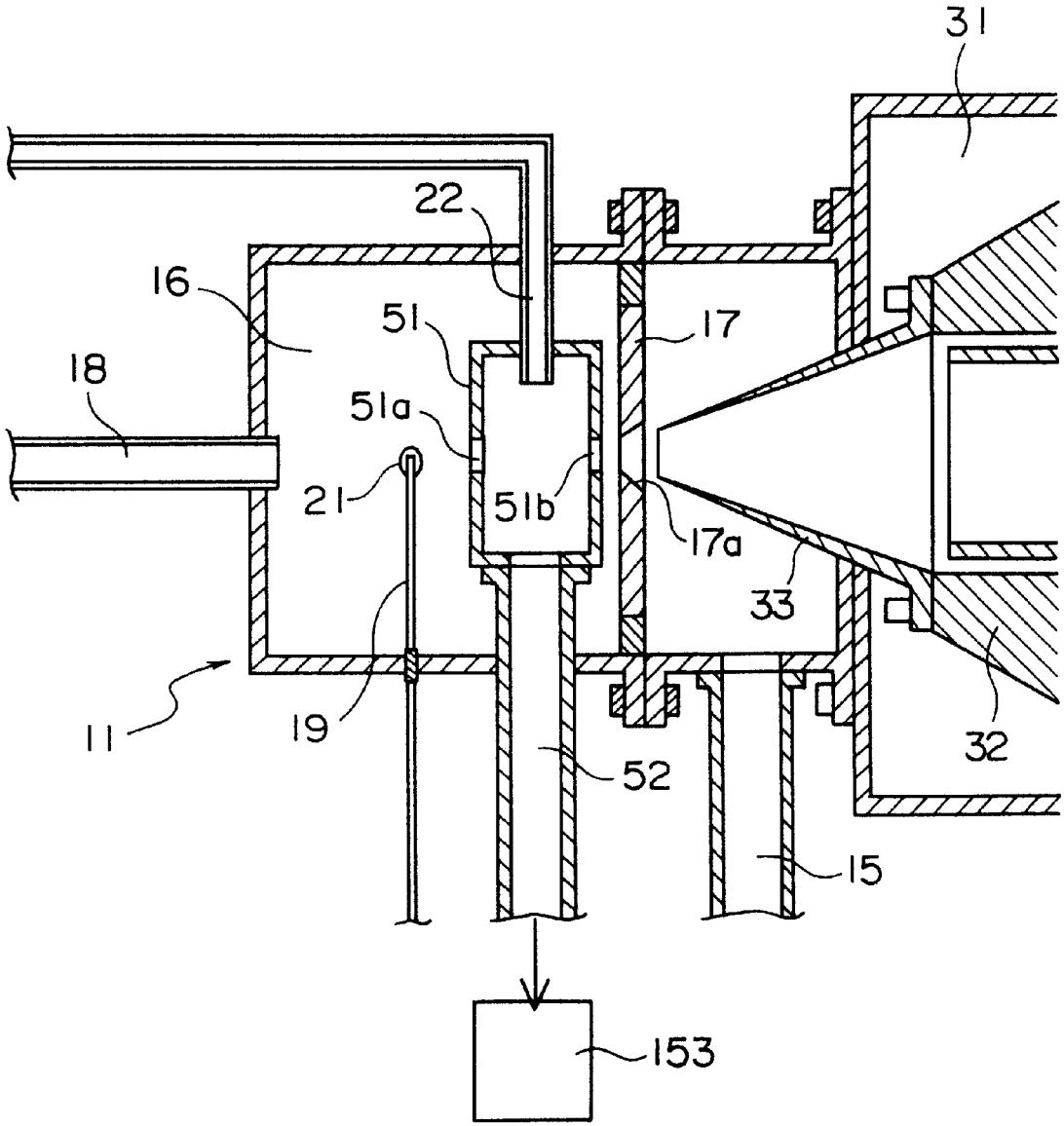
FIG. 7 is a similar longitudinal sectional view as FIG. 2 for a fifth embodiment of the present invention.

A fifth embodiment of the present invention will be explained with reference to FIG. 7. FIG. 7 is a view similar to FIG. 2. In FIG. 7, elements substantially the same as the elements explained in the previous embodiments are assigned the same reference numerals and detailed explanations thereof are omitted. In the fifth embodiment, to limit the diffusion region of the sample gas introduced by the sample gas inflow part 22, the second ionization chamber 51 is provided in the ionization chamber 16. The second ionization chamber 51 is arranged between the metal ion emitter 21 and the aperture plate 17. The second ionization chamber 51 has connected to it the opening part of the front of the sample gas inflow part 22. Further, a hole 51*a* is formed in the wall of the second ionization chamber 51 facing the metal ion emitter 21, while a hole 51*b* is formed in the wall facing the opening 17*a* of the aperture plate 17. Further, the second ionization chamber 51 has an evacuation pipe 52 connected to it to evacuate the inside by a vacuum pump 153 provided at the outside. The rest of the configuration is the same as for example the first embodiment.

The second ionization chamber 51 continues to be evacuated by the outside vacuum pump through the evacuation pipe 52 and the second gas flows continuously through the hole 51*a* provided in the container forming the second ionization chamber 51, so a flow of gas is formed in the ionization chamber 16 and the second ionization chamber 51. Therefore, it is possible to keep the diffusion region of the sample gas introduced by the sample gas inflow part 22 inside the second ionization chamber 51 and suppress contact with the sample gas and metal ion emitter 21.

Further, metal ions are supplied by the hole 51*a* provided at the metal ion emitter 21 side inside the second ionization chamber 51 based on the action of the electric field formed in the ionization chamber 16. The sample gas is ionized by the metal ions in the second ionization chamber 51. The ionized sample gas is transported to the ionization chamber 16 by the hole 51*b* provided at the aperture plate 17 side and transported to the mass spectrometer 13 from the opening 17*a* of the aperture plate 17.

Figure 8:
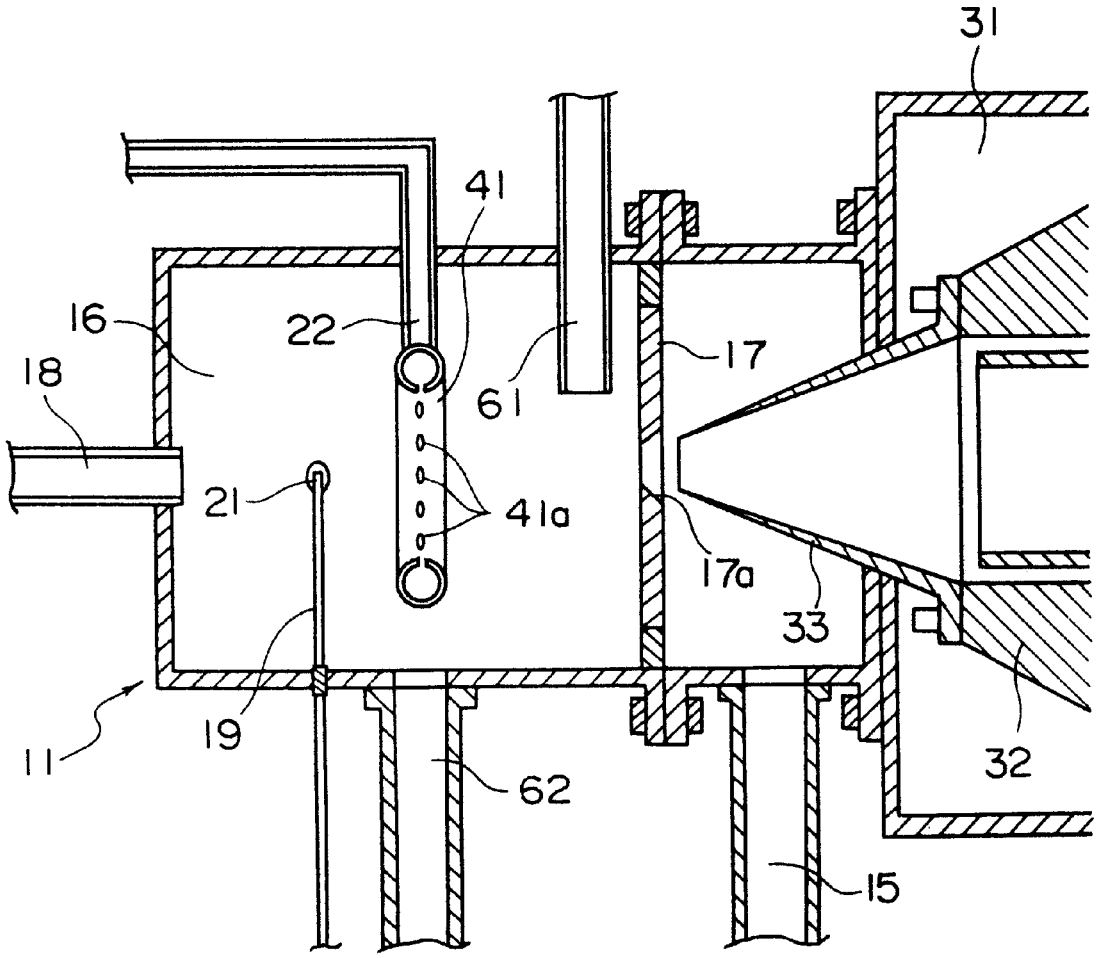
FIG. 8 is a similar longitudinal sectional view as FIG. 2 for a sixth embodiment of the present invention.

A sixth embodiment of the present invention will be explained with reference to FIG. 8. FIG. 8 is a view similar to FIG. 2. In FIG. 8, elements substantially the same as the elements explained in the previous embodiments are assigned the same reference numerals and detailed explanations thereof are omitted. In the sixth embodiment, the ionization chamber 16 is provided with the above second gas inflow part 18 and another second gas inflow part 61 at the downstream side of the donut-shaped tube 41 provided at the front of the sample gas inflow part 22. Compared with the second embodiment, the evacuation pipe 62 is provided at a location closer to the donut-shaped tube 41 of the sample gas inflow part 22 than the second gas inflow parts 18 and 61. The outer end of the evacuation pipe 62 is connected to a vacuum pump for evacuating the ionization chamber 16. According to this configuration, an upstream source of the second gas flow is formed at the two sides of the donut-shaped tube 41 of the sample gas inflow part 22 and the flows of the second gas are controlled from at least two regions toward a single region. Therefore, according to this configuration of the present embodiment, not only the contact of the sample gas with the metal ion emitter 21 is suppressed, but also the flow of the sample gas through the opening 17*a* provided at the aperture plate 17 to the mass spectrometry unit 13 can be prevented.

Figure 9:
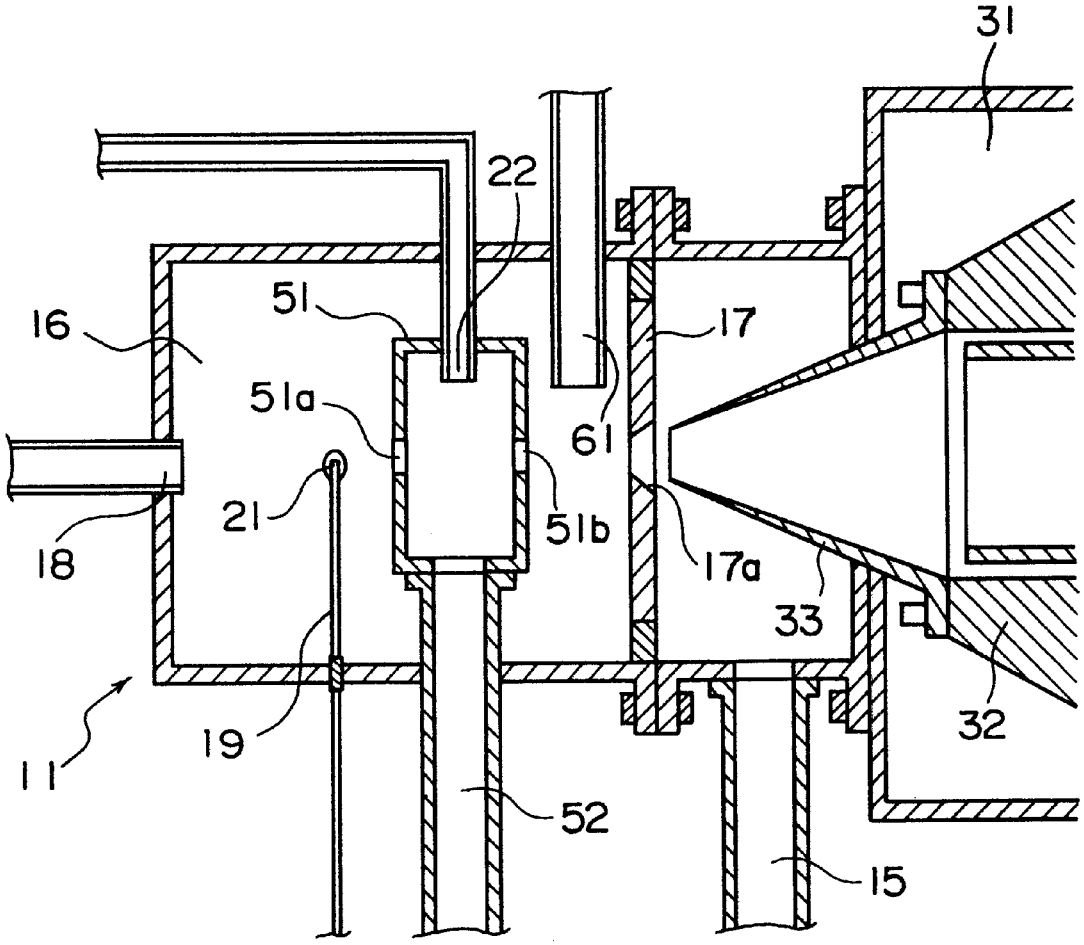
FIG. 9 is a similar longitudinal sectional view as FIG. 2 of a configuration obtained by combining the fifth and sixth embodiments.

Note that the sixth embodiment may be combined with the fifth embodiment. That is, as shown in FIG. 9, it is possible to provide the second ionization chamber 51 shown in FIG. 7 between the metal ion emitter 21 and the second gas inflow part 61. According to this configuration, it is possible to obtain the effect of the fifth embodiment and the effect of the sixth embodiment together.

Figure 10:
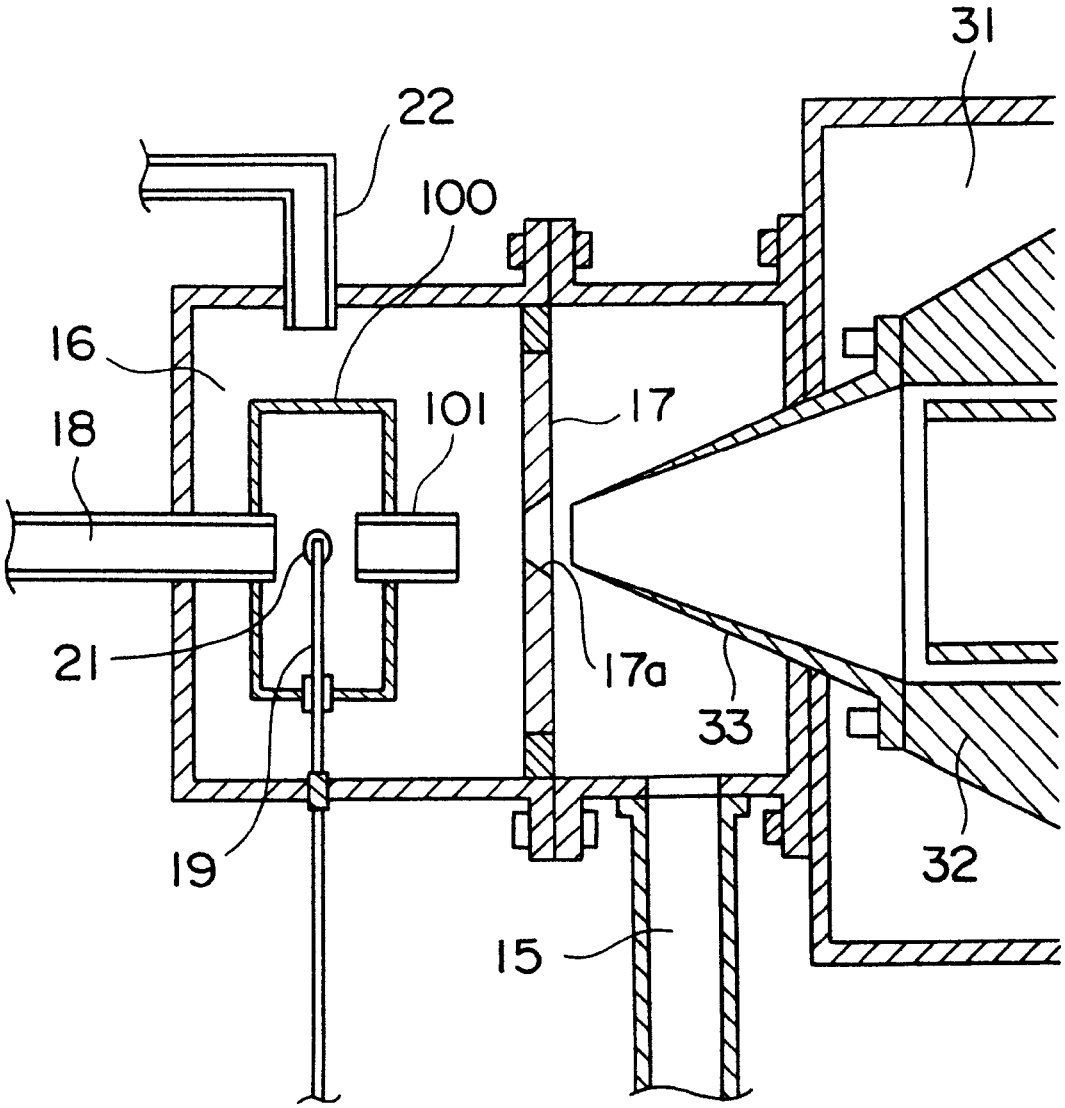
FIG. 10 is a similar longitudinal sectional view as FIG. 2 for a seventh embodiment of the present invention.

Next, a seventh embodiment of the present invention will be explained with reference to FIG. 10. FIG. 10 is a view similar to FIG. 2. In FIG. 10, elements substantially the same as the elements explained in the previous embodiments are assigned the same reference numerals and detailed explanations thereof are omitted. In the seventh embodiment, the ion emitter 21 is arranged in the emitter chamber 100. A second gas inflow part 18 is connected to the emitter chamber 100 and second gas is supplied in the emitter chamber 100. The emitter chamber 100 is provided with a tubular emitter chamber outlet 101 facing the opening 17*a*. In the above configuration, the second gas supplied by the second gas inflow part 18 enters the emitter chamber 100 and flows out from the emitter chamber outlet 101. Next, it passes through the inside space of the ionization chamber 16 and is evacuated from the opening 17*a* of the aperture plate 17. Compared with the flow of second gas at the emitter chamber 100 and ionization chamber 16, the flow of second gas at the emitter chamber outlet 101 becomes much faster since the sectional area in a direction perpendicular to the direction of flow is small.

In the seventh embodiment, the sample gas flows from the sample gas inflow part 22 provided near the emitter chamber 100 to the ionization chamber 16. The sample gas merges with the second gas between the emitter chamber outlet 101 and the opening 17*a*, that is, near the downstream side of the second gas. The flow rate of the second gas at the emitter chamber outlet 101 between the point where the sample gas merges with the second gas and the ion emitter 21 is fast and the region of the fast flow is long, so the sample gas almost never flows back to the emitter chamber outlet 101.

Figure 11:
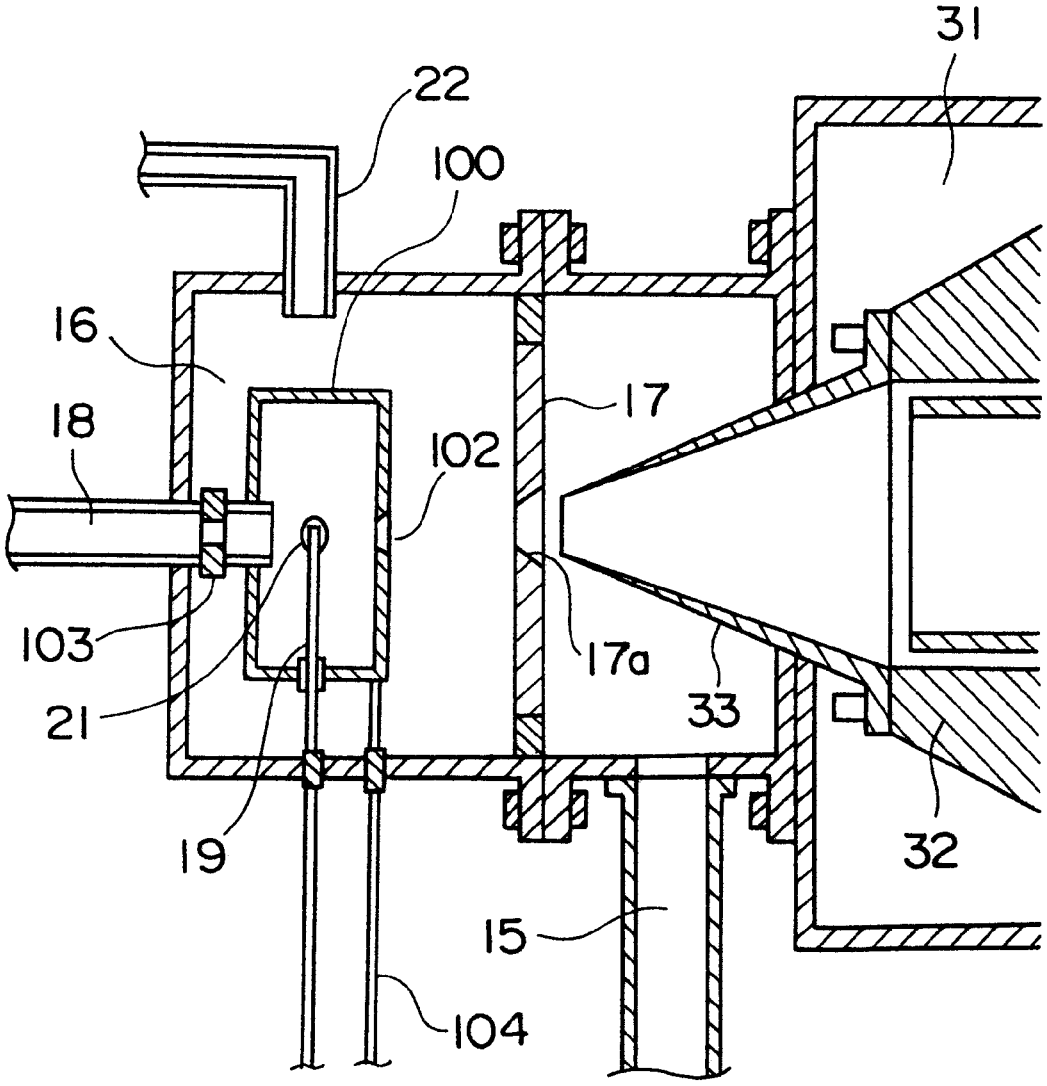
FIG. 11 is a similar longitudinal sectional view as FIG. 2 for an eighth embodiment of the present invention.

Next, an eighth embodiment of the present invention will be explained with reference to FIG. 11. FIG. 11 is a view similar to FIG. 2 or FIG. 10. In FIG. 11, elements substantially the same as elements explained in the above embodiments are assigned the same reference numerals and detailed explanations thereof are omitted. The eighth embodiment is a modification of the seventh embodiment.

In the eighth embodiment, the ion emitter 21 is arranged in the emitter chamber 100. The emitter chamber 100 is connected to a second gas inflow part 18 from which the second gas is supplied inside the emitter chamber 100. The second gas inflow part 18 is provided with an insulated tube 103. The emitter chamber 100 is provided with an aperture-shaped emitter chamber outlet 102 facing the opening 17*a*. In the above configuration, the second gas supplied by the second gas inflow part 18 enters the emitter chamber 100 and flows out from the emitter chamber outlet 102. Next, the gas passes through the inside space of the ionization space 16 and is evacuated from the opening 17*a* of the aperture plate 17. Since the sectional area of the emitter chamber outlet 102 is extremely small, the second gas is blown out from the emitter chamber outlet 102 at an extremely fast flow rate.

In the eighth embodiment, the sample gas flows from the sample gas inflow part 22 provided near the emitter chamber 100 to the ionization chamber 16. The sample gas merges with the second gas between the emitter chamber outlet 102 and the opening 17*a*, that is, near the downstream side of the second gas. Since the flow of the second gas at the emitter chamber outlet 102 between the point where the sample gas merges with the second gas and the ion emitter 21 is extremely fast, the sample gas almost never flows backward to the emitter chamber outlet 102. Further, a voltage line 104 is connected to the emitter chamber 100

In the configuration of the eighth embodiment, the region of fast flow was short, but the flow rate was extremely large. Therefore, the effect is the same as the case of the seventh embodiment. the transport of ions by being blown from the emitter chamber outlet 102 is disturbed, but since a suitable voltage is applied to the emitter chamber 100 through the voltage line 104, the ions are efficiently transported by the electric field along with the flow of gas. The above voltage is applied to the emitter chamber 100 by an insulated tube 103 and voltage line 104.

The present invention can be configured in any way by combining the features of the embodiments explained above. Further, in the above explanation of the embodiments, the configuration of the apparatus according to the present inventions shown in the drawings was shown schematically to an extent enabling understanding of the invention. The limitations on the substances and figures shown are however only illustrations. Therefore, the present invention is not limited to the above embodiments and of course may be applied in various manners within a scope not outside the technical concept described in the claims.

The present disclosure relates to subject matter contained in Japanese Patent Application No. 2000-242473, filed on Aug. 10, 2000, the disclosure of which is expressly incorporated herein by reference in its entirety.

What is claimed is:

1. A method of ionization for mass spectrometry attaching metal ions to a sample gas in an ionization chamber to produce sample gas ions, passing the sample gas ions through a mass spectrometer formed by an electromagnetic field for separation by mass, and detecting and measuring the mass separated sample gas ions as an ion current, and further the method producing said sample gas ions by steps of making a region controlled to be a reduced pressure atmosphere where the flow of gas becomes a viscous flow, producing said metal ions at the upstream side of said region, transporting said metal ions to the downstream side by at least the flow of gas formed inside the ionization chamber, and introducing the sample gas to the downstream side region.

2. A method of ionization for mass spectrometry as set forth in claim 1, further comprising successively replacing the atmosphere with a second gas introduced to said ionization chamber to produce a flow of gas in an evacuation direction to evacuate said ionization chamber from a second gas inflow part through a metal ion producing region and sample gas ionization region.

3. A method of ionization for mass spectrometry as set forth in claim 2, where an inflow position of the second gas introduced to said ionization chamber is at the upstream side of said metal ion producing region.

4. A method of ionization for mass spectrometry as set forth in claim 2, further comprising reducing a conductance of a mid-stream region between a downstream side region where said sample gas is introduced and an upstream side region where said metal ions are produced so that the flow rate of the flow of gas becomes the fastest in said mid-stream region.

5. A method of ionization for mass spectrometry as set forth in claim 1, where the reduced pressure atmosphere for making the flow of gas a viscous flow is controlled by an evacuation action by a differential evacuation mechanism arranged at said downstream side.

6. A method of ionization for mass spectrometry as set forth in claim 1, where the reduced pressure atmosphere for making the flow of gas a viscous flow is controlled by a gas introduction action by a gas introduction system.

7. A method of ionization for mass spectrometry as set forth in claim 1, wherein said sample gas is one of an organic compound gas, a halogen gas and halogen-based radicals.

8. A mass spectrometry apparatus in which metal ions are attached to a sample gas in an ionization chamber to produce sample gas ions, the sample gas ions are passed through a mass spectrometer formed by an electromagnetic field for separation by mass, and the mass-separated sample gas ions are detected and measured as an ion current by a detector, said mass spectrometry apparatus further comprising;

a region controlled to be a reduced pressure atmosphere where the flow of gas becomes a viscous flow, a metal ion emitter for emitting said metal ions arranged at an upstream side of said region, and a sample gas inflow part for introducing the sample gas arranged at a downstream side where said emitted metal ions are transported, wherein the sample gas ionized by attachment of metal ions is transported through an opening of an aperture plate to said mass spectrometer.

9. A mass spectrometry apparatus as set forth in claim 8, wherein said opening of said aperture plate is used as an evacuation port, a second gas is introduced from a second gas inflow part provided at a most upstream-side position of said ionization chamber, and thereby a flow direction of the gas flow becomes a direction from said second gas inflow part to said opening of said aperture plate through a region where said metal ion emitter is arranged and a region where said sample gas inflow part is arranged.

10. A mass spectrometry apparatus as set forth in claim 8, wherein a second ionization chamber is arranged between said metal ion emitter and said aperture plate, said sample gas inflow part is connected to a second ionization chamber so that said sample gas is introduced inside, holes are formed at each side of said metal ion emitter and aperture plate of a container forming said second ionization chamber, an evacuation part is provided at the second ionization chamber, and said second gas is introduced from said second gas inflow part while evacuating the ionization chamber from said evacuation part.

11. A mass spectrometry apparatus as set forth in claim 8, wherein said second gas inflow part is arranged at regions of a front side and rear side of said sample gas inflow part in said ionization chamber in a direction of gas flow, an evacuation unit is provided at a position closer to a region of arrangement of the sample gas inflow part than regions of arrangement of said second gas inflow parts, and a flow of gas is formed in a direction from said second gas inflow parts through the region of arrangement of said sample gas inflow part to said evacuation part.

12. A mass spectrometry apparatus as set forth in claim 8, wherein in a mid-stream region between said region where the sample gas is introduced and the region where metal ions are produced, a wall forming said ionization chamber is provided with a structural part for reducing the sectional area in a direction perpendicular to the flow of gas from another region.

13. A mass spectrometry apparatus as set forth in claim 8, wherein a front end of said sample gas inflow part is made a donut-shaped tube having a plurality of gas discharge ports and the sample gas is quickly diffused near the region where the sample gas flows in.

14. A mass spectrometry apparatus as set forth in claim 8, wherein curved parts are provided at inside walls of corners of said ionization chamber to create said viscous flow of gas without causing gas pockets.

15. A mass spectrometry apparatus as set forth in claim 8, wherein an emitter chamber is provided inside said ionization chamber, said metal ion emitter is arranged inside said emitter chamber, and said emitter chamber is connected to said second gas inflow part and has a tubular outlet.

16. A mass spectrometry apparatus as set forth in claim 15, wherein said emitter chamber has an aperture-shaped opening instead of said tubular outlet.

17. A mass spectrometry apparatus as set forth in claim 8, wherein the reduced pressure atmosphere for making the flow of gas a viscous flow is controlled by an evacuation action by a differential evacuation mechanism arranged at said downstream side.

18. A mass spectrometry apparatus as set forth in claim 8, wherein the reduced pressure atmosphere for making the flow of gas a viscous flow is controlled by a gas introduction action by a gas introduction system.

19. A mass spectrometry apparatus as set forth in claim 8, wherein said sample gas is one of an organic compound gas, a halogen gas and halogen-based radicals.

* * * * *